US005184684A

United States Patent [19]

Kohlman

[11] Patent Number: 5,184,684

[45] Date of Patent: Feb. 9, 1993

[54] CONTAINER FOR A FIRE EXTINGUISHER

[76] Inventor: Daniel M. Kohlman, Box 471, Macklin, Saskatchewan, Canada, S0L 2C0

[21] Appl. No.: 737,434

[22] Filed: Jul. 29, 1991

[51] Int. Cl.[5] ..... A62C 13/78

[52] U.S. Cl. ..... 169/51; 312/248; 312/329

[58] Field of Search ..... 169/51; 312/245, 246, 312/248, 252, 326, 329, 249.2

[56] References Cited

U.S. PATENT DOCUMENTS

| | | | |
|---|---|---|---|
| 3,067,822 | 12/1962 | Hattenhauer | 169/51 |
| 3,220,791 | 11/1965 | Pokryfke et al. | 312/242 |
| 4,046,439 | 9/1977 | Lee | 312/139.2 |
| 4,548,274 | 10/1985 | Simpson | 169/51 |
| 4,763,732 | 8/1988 | Neal | 169/51 |
| 5,039,179 | 8/1991 | Chouzenoux | 312/329 |

*Primary Examiner*—Charles A. Marmor
*Assistant Examiner*—Andrew C. Pike
*Attorney, Agent, or Firm*—Adrian D. Battison; Stanley G. Ade; Murray E. Thrift

[57] ABSTRACT

A container for a fire extinguisher is of a lazy susan type including an inner housing and an outer housing on which the inner housing is rotatable about a vertical axis. The outer housing includes an octagonal top with a depending surrounding flange. The inner housing includes two side flanges which project outwardly to engage cooperating flanges on the outer housing for providing a vertical lip seal along the sides of the inner housing. The top and bottom panels of the inner housing are spaced from the top and bottom panels of the outer housing to allow an air flow through this area to maintain the housing free from condensation of the moisture.

16 Claims, 5 Drawing Sheets

CONTAINER FOR A FIRE EXTINGUISHER

BACKGROUND OF THE INVENTION

This invention relates to a container for a fire extinguisher of a type which is particularly but not exclusively designed for mounting on a suitable support structure in an exposed environment, for example outside adjacent an area to be protected.

It is becoming more important under the present conditions of environmental and safety awareness to provide fire extinguishers at all areas where danger of a fire can occur for example adjacent fuel tanks, oil and gas equipment, and the like.

Previous designs have been proposed for fire extinguisher containers which hold the fire extinguisher in a protected manner but allow it to be readily accessible for use. However, generally these designs have been somewhat unsatisfactory and there remains certainly an opportunity for an improved design which will provide significant enhanced features to make it more suitable for the purpose.

One example of a fire extinguisher housing is shown in U.S. Pat. No. 3,220,791 (Pokryfke et al.) which discloses a shallow container with a semicylindrical rear wall which is mounted in a support wall in an indentation in the wall. A semicylindrical inner housing is mounted in the outer housing for rotation about a vertical axis with the inner housing receiving the fire extinguisher therein. The fire extinguisher is exposed by rotating the inner housing from an initial closed to an open position in which the inner housing is turned through 180° to expose the inside surface of the inner housing and the fire extinguisher.

However, this device has a number of disadvantages. Firstly, the mounting system within a wall cavity makes it very restricted in the possible location of use. Secondly, the design has a number of serious disadvantages in that it does not properly protect against the environment in that it will allow the entry of moisture in the form of rain or snow, which when frozen could seriously interfere with the opening of the device. The housing is therefore probably only suitable for an interior location.

Other examples are shown in U.S. Pat. Nos. 3,067,822 (Hattenhauer); 4,046,439 (Lee); 4,548,274 (Simpson) and 4,763,732 (Neal).

The patents of Lee, Neal and Hattenhauer each describe an arrangement in which there is a housing which is substantially rectangular including a hollow box section defining a rear part and a front door. Devices of this type are highly unsatisfactory in that the door can be difficult to open and can be dangerous in high wind conditions thus interfering with the ready access of the user to the fire extinguisher.

The Simpson device comprises a decorative enclosure which is intended to be opened by a sliding front door on detection of an alarm condition. An arrangement of this type might be highly attractive but is completely impractical in an exterior location where it is difficult to detect the alarm condition and where the device is open to the environment.

SUMMARY OF THE INVENTION

It is one object of the present invention, therefore, to provide an improved fire extinguisher housing which is particularly suitable for exterior mounting without necessity for an available wall and which provides ready access to the fire extinguisher for immediate use.

It is a further object of the present invention to provide an improved housing construction which more effectively accomodates the effects of the environment, for example rain, snow, and freezing, without danger of the housing becoming difficult or impossible to open for immediate access of the fire extinguisher.

According to the invention there is provided a container for a fire extinguisher comprising an outer housing having a top substantially horizontal panel, a bottom substantially horizontal panel, and a rear generally vertical panel interconnecting the top and bottom panels; attachment means for mounting the outer housing on a support member with a front open face of the outer housing exposed, an inner housing comprising a top substantially horizontal panel, a bottom substantially horizontal panel and a substantially vertical panel interconnecting the top and bottom panels of the inner housing; means for mounting the fire extinguisher in the inner housing; and pivot means mounting the bottom panel of the inner housing on a top of the bottom panel of the outer housing and mounting the top panel of the inner housing underneath the top panel of the outer housing for pivotal movement of the inner housing relative to the outer housing about a common substantially vertical axis from a first position in which the vertical panel of the inner housing faces forwardly and cooperates with the rear panel of the outer housing to substantially enclose a hollow interior for receiving the fire extinguisher to a second position in which the vertical panel of the inner housing lies adjacent the rear panel of the outer housing with the fire extinguisher exposed forwardly of the vertical panel of the inner housing; said attachment means comprising a bracket member mounted upon a rear face of the vertical panel of the outer housing, the bracket member having connector means for attachment to said support member such that the outer housing is presented forwardly from the support member.

One or more embodiments of the invention will now be described in conjunction with the accompanying drawings.

BRIEF DESCRIPTION OF THE DRAWINGS

In the drawings like characters of reference indicate corresponding parts in the different figures.

DETAILED DESCRIPTION

Figure 4:
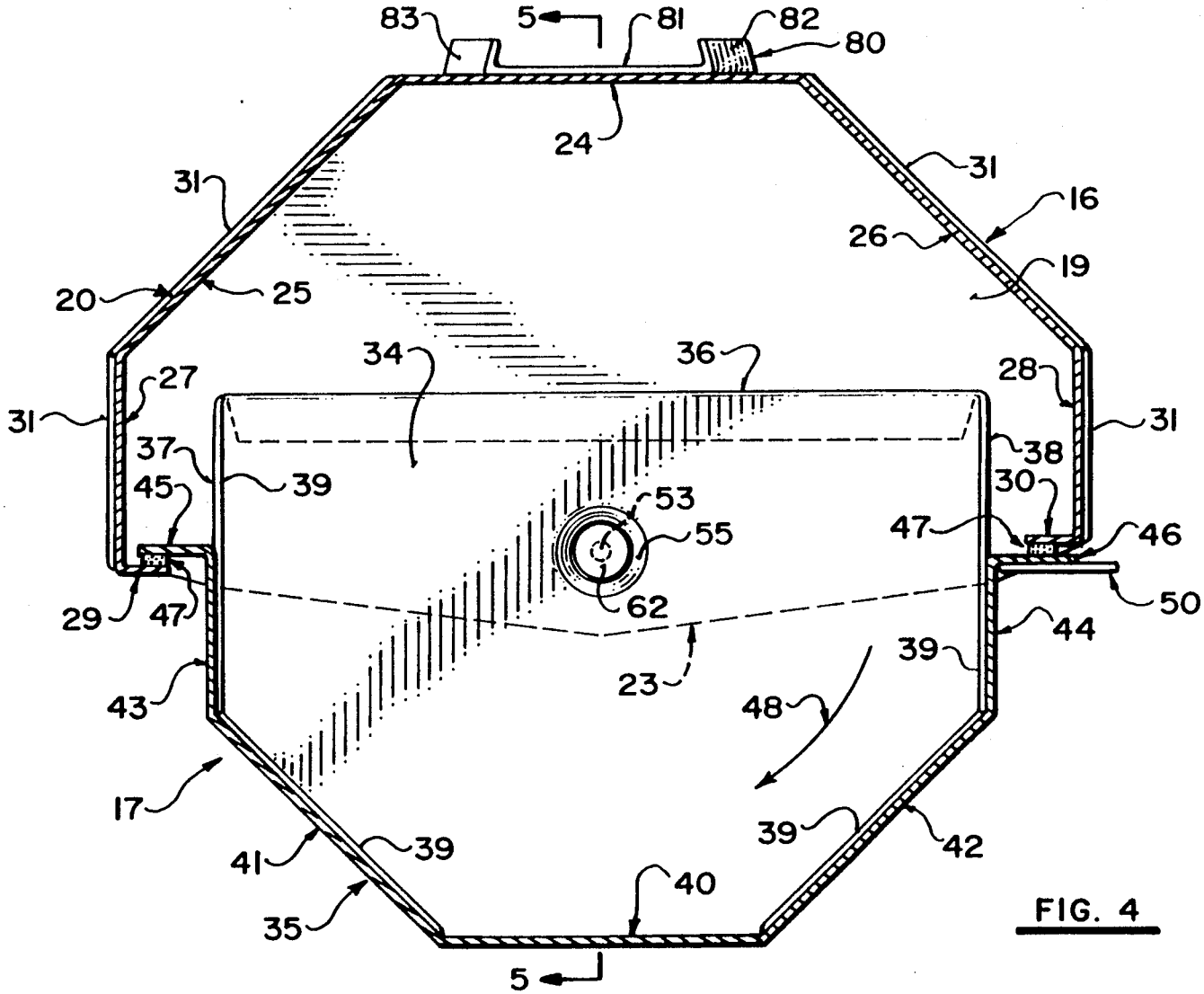
FIG. 4 is a cross-sectional view along the lines 4—4 of FIG. 1.
Figure 6:
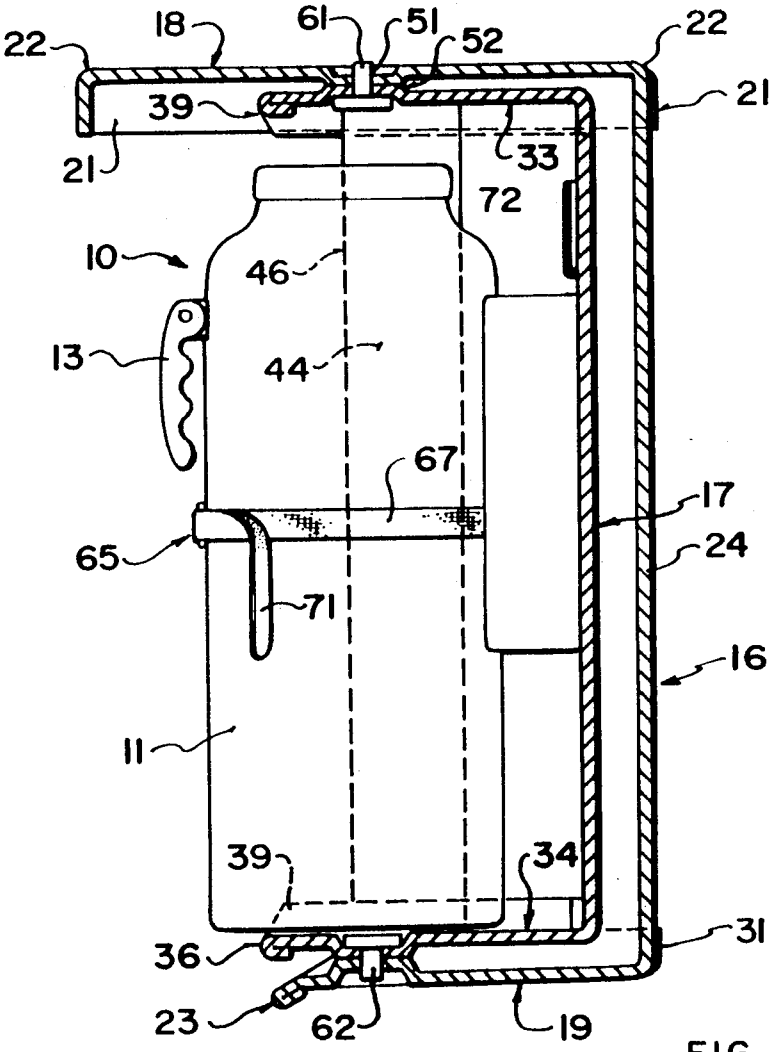
FIG. 6 is a view similar to that of FIG. 5 showing the container in the open condition.

A fire extinguisher 10 is of a conventional construction including a bottle section 11, a top 12, a handle 13, and a discharge hose 14. The conventional fire extinguisher is mounted in a container 15. The container 15 includes an outer housing 16 and an inner housing 17. The outer housing 16 includes a top panel 18, a bottom panel 19, and a rear panel 20. The top panel 18 is substantially planar and octagonal in plan with a plurality of downturned flanges 21 each at a respective one of the edges 22 of the octagonal shape so that the flanges interconnect edge to edge to provide a downturned lip surrounding the full periphery of the upper panel. The lower panel 19 forms substantially one half of the shape of the upper panel as best shown in FIG. 4 with a forward edge of the lower panel being indicated at 23 which extends across the panel just in front an imaginary line passing through the center of the hexagon. The rear panel 20 is bent to form five panel sections. A rearmost panel section 24 defines a flat rear face of the housing and corresponds to the side of the hexagon forming the top and bottom panels. Two further sides 25 and 26 are bent at an angle of 60° relative to the rear side 24. Two side portions 27 and 28 which project forwardly from the rear 24 define sides of the outer housing. At a front vertical edge of each of the sides 27 and 28 is provided a flange indicated respectively at 29 and 30 which is turned inwardly at right angles to the side and extends inwardly therefrom. The bottom panel 19 includes upturned sides 31 similar to the downturned sides 21 of the top panel with the upturned sides 31 arranged only adjacent those parts of the rear panel so that the bottom panel, top panel, and rear panel can be welded together at the overlapped sides to form an integral construction.

Figure 1:
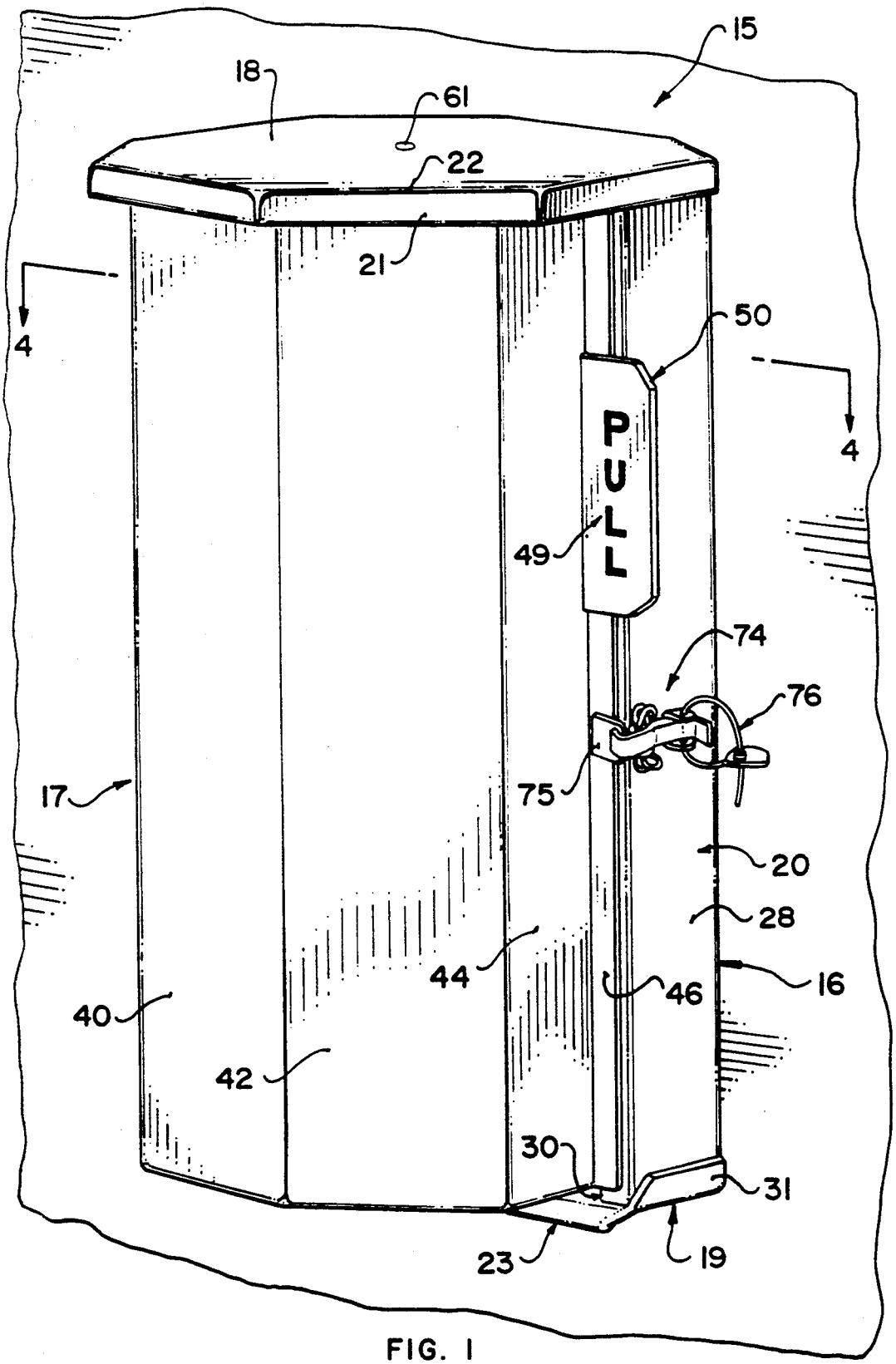
FIG. 1 is an isometric view of the fire extinguisher housing according to the present invention mounted upon a wall with the housing in the closed position fully enclosing the fire extinguisher.
Figure 2:
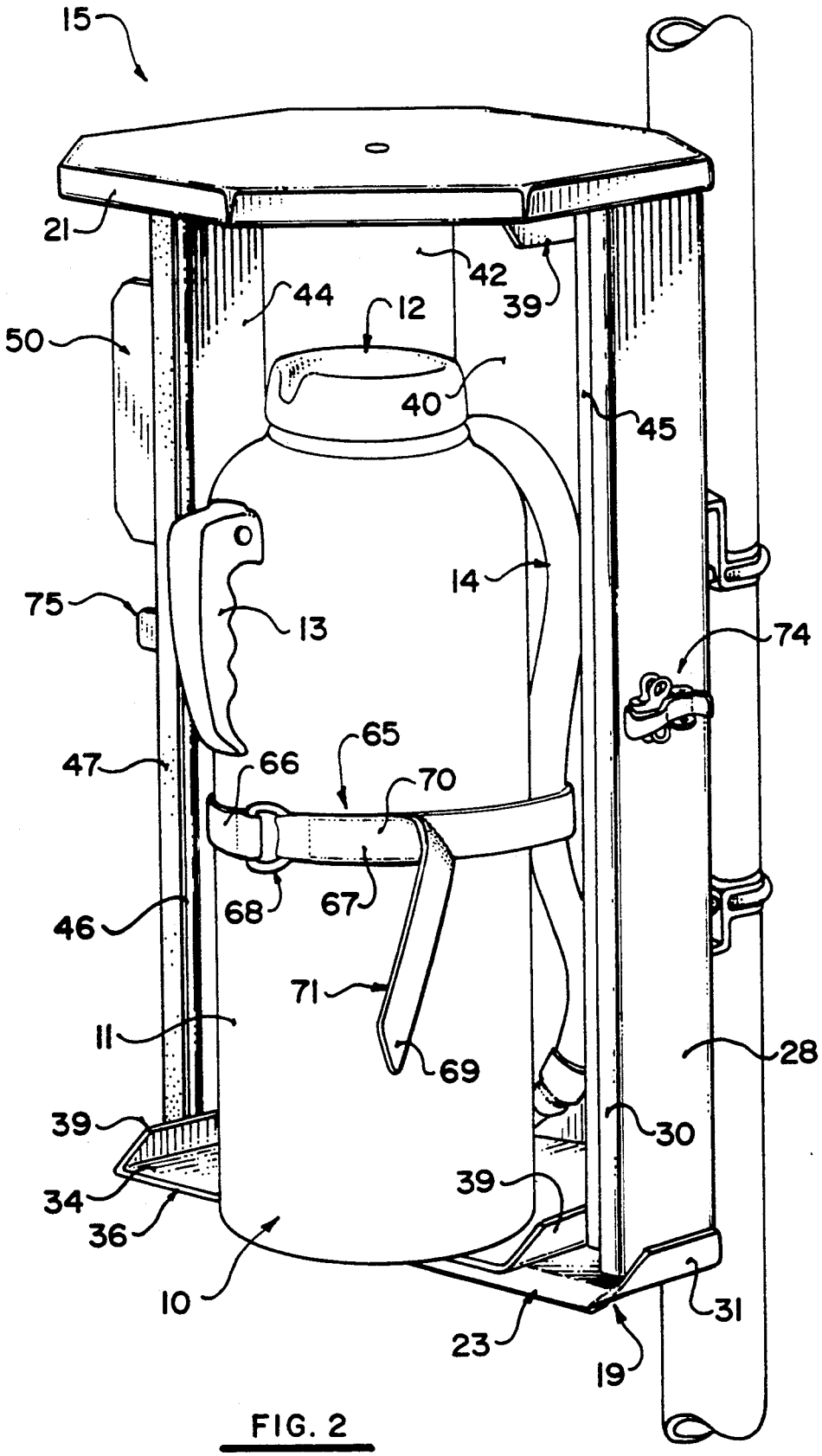
FIG. 2 is a view similar to that of FIG. 1 showing the housing of FIG. 1 in an open condition in which the fire extinguisher is accessible, the housing being mounted upon a support pipe.

The inner housing 17 is formed in a similar manner including a top panel 33, a bottom panel 34, and a vertical panel 35. The shape of the bottom panel is shown best in FIG. 4 and the shape of the top panel is identical to the shape of the bottom panel. The shape comprises basically five sides of the octagon shape corresponding to the octagonal shape of the outer housing. A rear edge 36 of the top and bottom panels extends directly across from side walls 37 and 38 which extend parallel to the side walls 27 and 28 of the outer housing. Again the top and bottom panels include downturned side flanges 39. A flange at the edge 36 is turned back through 180° and is welded flat on the underside of the planar sheet forming the top or bottom panel for strength purposes at the edge 36. The vertical panel includes five panel sections each associated with a respective edge of the octagonal shape of the top and bottom panels. Thus the vertical panel includes a front panel portion 40, two inclined panel portions 41 and 42, and two side panel portions 43 and 44. The rearward edge of each of the side panels 43 and 44 includes an outward turned flange 45, 46 defined at right angles to the side and projects therefore outwardly toward the side 27, 28 respectively of the outer housing. Each of the flanges 45 and 46 carries a sealing member 47 in the form of an elongate strip of a resilient material at an outside edge thereof at a portion thereof which overlaps with the flange 29, 30 of the side of the outer casing so that the sealing strip 47 can provide a seal between the overlying flange portions. It will be noted that the flange 29 is forwardly of the flange 45, and on the opposite side of the housing the position is reversed in that the flange 46 is forward of the flange 30. This allows the inner housing to rotate in the direction of the arrow 48 but only in that direction from the closed position shown in FIGS. 1, 4, and 5. A pull handle 50 is attached to the flange 46 at one point along the length thereof and carries the indicia "PULL" as indicated at 49. The pull handle thus projects outwardly from the side of the flange and is readily visible at the front of the housing when the user approaches the housing and can be grasped and pulled to cause the housing to rotate in the direction of the arrow 48.

Figure 5:
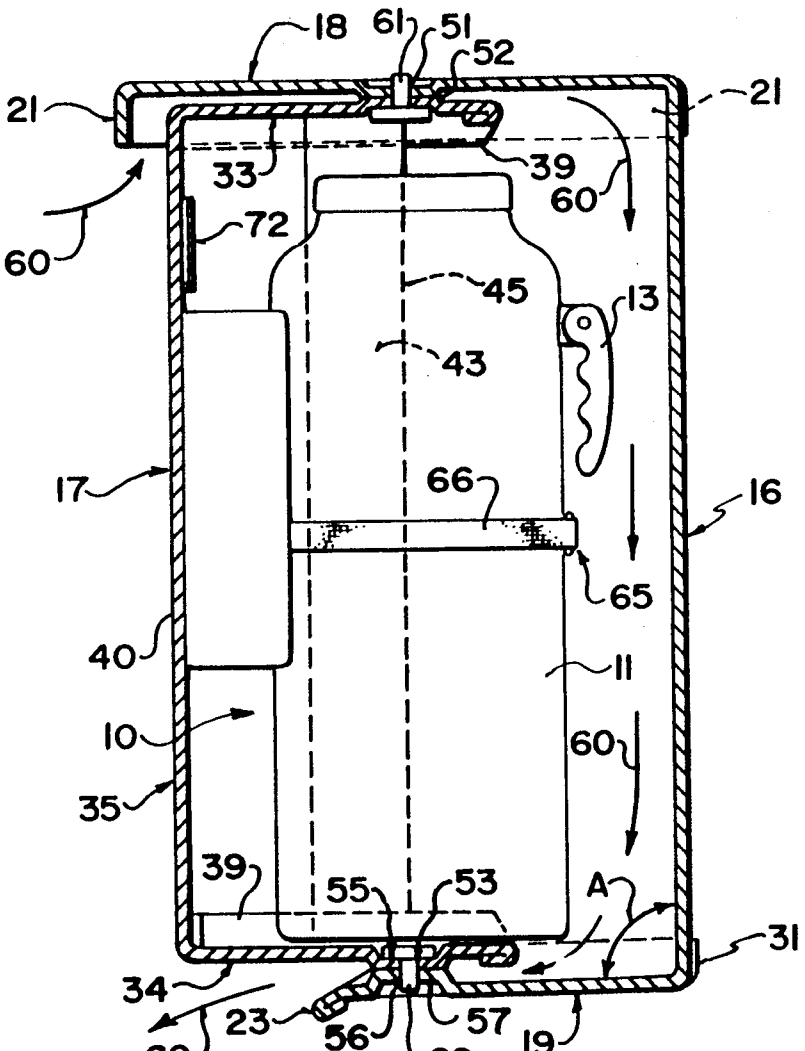
FIG. 5 is a cross-sectional view along the lines 5—5 of FIG. 4.

The top panel 33 of the inner housing includes a hole 51 at the center of a circular raised portion 52 as best shown in FIG. 5. Similarly the bottom panel 34 includes a hole 53 and a depressed circular portion 55. The bottom panel 19 of the outer housing also includes the hole 56 and the raised circular portion 57. All of these holes and portions are aligned to define a rotation axis for the inner housing on the outer housing. These depressed and raised portions of the material formed by a punch die arrangement raise the main body of the panels of the inner housing away from the top and bottom panels of the outer housing. This arrangement assists in providing an effective bearing action and allowing rotation even when moisture has frozen within the housing. In addition, this arrangement provides an air passage through the housing as best shown in FIG. 5 along the arrow line 60 with the air passing under the front flange 21 of the top panel of the outer housing, across the space between the top panel of the inner housing and the top panel of the outer housing, down along the interior of the housing, and out under the bottom panel of the inner housing. This allows moisture to be dried by a continual airflow to maintain the housing free from condensation for the purposes of extended life and to prevent damaging freezing of any collected moisture.

In addition, the bottom panel 19 of the outer housing is inclined at an angle A greater than 90° so as to allow any moisture collecting against the bottom panel to run outwardly to the front lip of the bottom panel and to drop to the ground from that place.

The rotation of the inner housing relative to the outer housing is provided on pins 61 and 62 mounted on the inside surface of the inner housing and projecting outwardly through the top and bottom panels respectively of the outer housing to provide the pivot axis.

The fire extinguisher is supported against the inside surface of the front panel portion 40 of the inner housing by a strap 65 including a first strap portion 66 and a second strap portion 67. The first strap portion 66 includes a loop 68 through which the end section 69 of the second strap 67 can pass. A hook and loop fastening system of conventional nature is provided on the facing portions of the second strap to hold these portions together as indicated at 70 leaving a tail 71 hanging downwardly from the connected hook and loop fastener. This tail is therefore readily available for a user to grasp and to pull to release the fire extinguisher immediately. The handle 13 of the fire extinguisher is presented forwardly at this time and projects forwardly beyond the side flanges 45 and 46 so that it is readily available to be grasped.

An inspection card holder 72 is mounted also on the inside surface of the front panel portion 40 so that it is accessible only after removal of the fire extinguisher. It can be ensured therefore that the inspection card is completed and attended to only after the fire extinguisher has been removed and therefore fully inspected.

A snap fastening system 74 is provided on the side 28 of the outer housing and cooperates with a lip 75 on the flange 46. A frangible seal 76 can be located through the snap fastening system to ensure that the snap fastener is not opened without breaking the seal 76.

Figure 3:
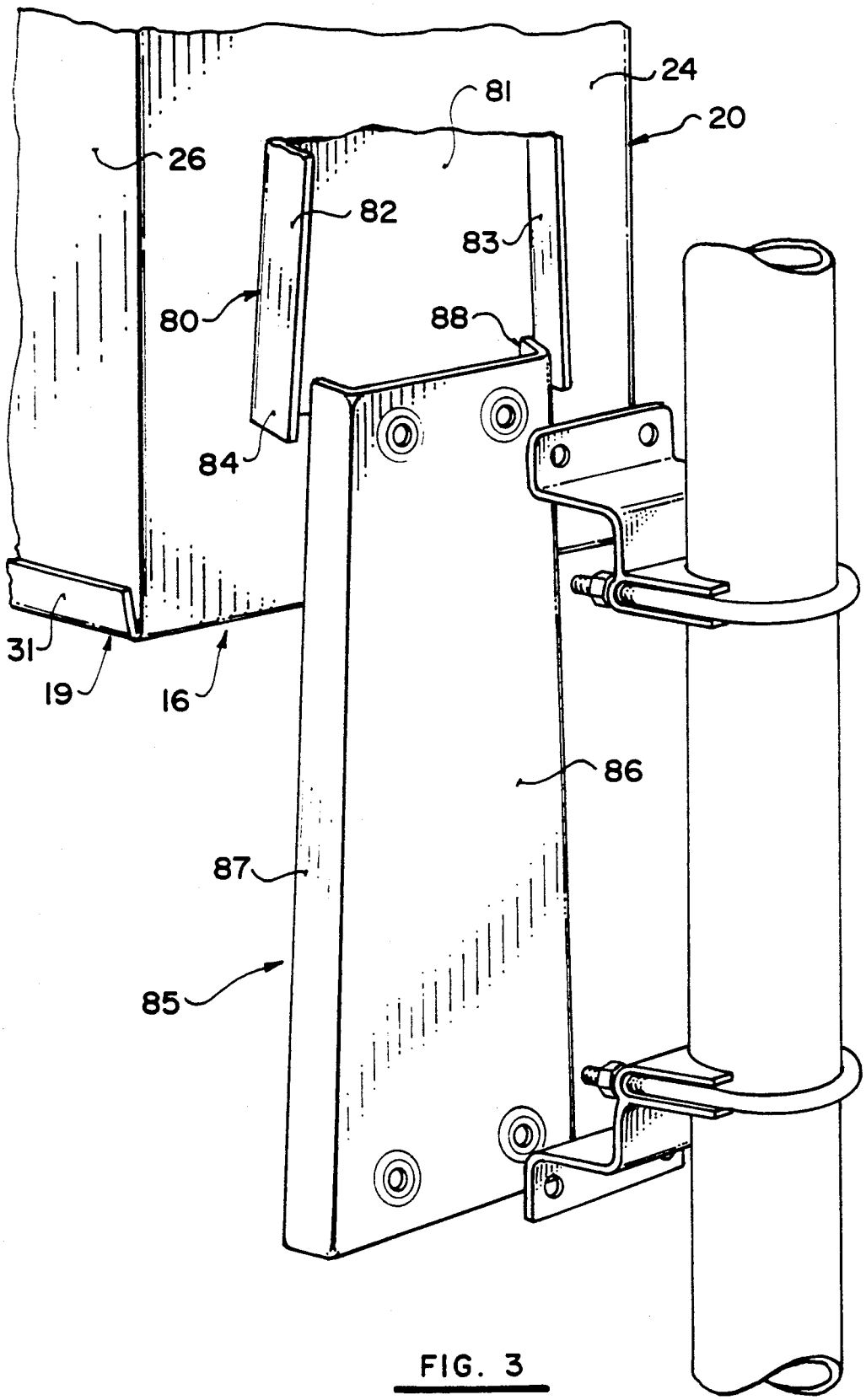
FIG. 3 is an isometric view from the rear of the container of FIG. 2 showing the container in a partially erected condition.

The outer housing is mounted upon a suitable support by a bracket system shown in FIGS. 3 and 4. The bracket system includes a channel member 80 provided on the outside surface of the rear panel portion 24 of the outer housing. The channel member includes a web 81 attached to the outside surface of the panel portion 24 and a pair of generally rearwardly extending flanges 82 and 83. However the flanges 82 and 83 are inclined rearwardly and inwardly to form a wedge shape. In addition, the flanges 82 and 83 taper inwardly and upwardly so that the spacing between the flanges at a lower end 84 of the flanges is wider than the spacing at the top end. A bracket member 85 is provided for attachment to the channel 80; the bracket member includes a flat plate 86 and a pair of side flanges 87 and 88. The plate 86 tapers so that it is narrower at the top than the bottom so that the flanges follow this taper. In addition, the flanges are inclined from the plate outwardly so as to follow the shape of the flanges 82 and 83.

With the bracket member 85 attached to a surface, therefore, the housing can be simply slipped into place by inserting the flanges 87 and 88 inside the flanges 82 and 83 at the bottom end of the flanges 82 and 83 and then sliding the housing downwardly until it is wedged in place by the taper in the bracket system. The plate 86 can be directly bolted to a wall as. shown in FIG. 1 or a plate 86 can be attached to a pipe clamp system as shown in FIG. 3.

The fire extinguisher as shown can be used particularly in an outdoor environment since it is resistant to the entrance of moisture due to the construction of the top panel of the outer housing protecting the upper part of the inner housing and in view of the seals along the sides of the inner and outer housings. However the housing can of course be used in other areas in view of other superior qualities.

The unique design of the container exposes a portion of the fire extinguisher and the handle of the fire extinguisher when the door is moved to the open position. This allows the operator to remove the fire extinguisher much more easily because the fire extinguisher is not set back inside the container with the handle turned to one side as in the case with many other such containers.

The octagon shape is preferred rather than a cylindrical shape as it provides a flat surface at the rear of the housing which allows a more rigid surface for the mounting hardware.

The tamperproof seal on the door latch must be broken in order to enter the cabinet if the purchaser wishes to use a seal. Once the seal has been broken this would warn that the contents should be inspected immediately and restored to operating condition if necessary.

The lip seals formed on the inner and outer body panels provide a surface for a weathertight seal for outdoor applications. These lip seals also act to stop when the door is in the open and closed position so that the door cannot rotate through 360° but is stopped at the open and closed positions.

The recessed portions on the upper and lower panels of the inner housing and the lower panel of the outer housing provide a surface of approximately three quarters-inch diameter for the inner cabinet to rotate on. This feature allows the cabinet to pivot relatively freely even under heavy loads due to the reduced friction area. This feature also allows the cabinet to pivot freely in harsh weather conditions such as freezing rain. This space also allows air to circulate through the cabinet when in a closed position to dry any moisture which could occur from condensation to prolong the cabinet life.

The downturned lip around the upper lid of the outer cabinet allows the inner cabinet to rotate freely behind this lip while preventing snow and rain from entering the inner chamber when the inner housing is in the closed position.

The lazy susan style door allows the contents to be removed easily without interference from swinging doors which can be caused from high winds.

The strap arrangement and the large well-marked handle allow the operator to open and operate the cabinet even if he is wearing gloves, as for example, could occur in the winter season.

The position of the inspection card holder inside the inner housing requires the operators to remove the contents for inspection in order to sign and date the inspection card.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A container for a fire extinguisher comprising an outer housing having a top substantially horizontal panel, a bottom substantially horizontal panel, and a rear generally vertical panel interconnecting the top and bottom panels; attachment means for mounting the outer housing on a support member with a front open face of the outer housing exposed, an inner housing comprising a top substantially horizontal panel, a bottom substantially horizontal panel and a substantialy vertical panel interconnecting the top and bottom panels of the inner housing; means for mounting the fire extinguisher in the inner housing; and pivot means mounting the bottom panel of the inner housing on a top of the bottom panel of the outer housing and mounting the top panel of the inner housing underneath the top panel of the outer housing for pivotal movement of the inner housing relative to the outer housing about a common substantially vertical axis from a first position in which the vertical panel of the inner housing faces forwardly and cooperates with the rear panel of the outer housing to substantially enclose a hollow interior for receiving the fire extinguisher to a second position in which the vertical panel of the inner housing lies adjacent the rear panel of the outer housing with the fire extinguisher exposed forwardly of the vertical panel of the inner housing; said attachment means comprising a bracket member mounted upon a rear face of the vertical panel of the outer housing, the bracket member having connector means for attachment to said support member such that the outer housing is presented forwardly from the support member.

2. The container according to claim 1 wherein the rear panel of the outer housing includes a flat rear sheet on which said bracket member is mounted.

3. The container according to claim 2 wherein the vertical panel of the outer housing and the vertical panel of the inner housing both have flat surfaces arranged so that in the first position the container is substantially octagonal in cross section.

4. The container according to claim 1 wherein the top panel of the outer housing extends forwardly to a position outwardly of the top panel of the inner housing in the first position thereof and includes a downturned lip around a periphery thereof for enclosing the top panel of the inner housing.

5. The container according to claim 1 wherein the rear panel of the outer housing includes sides thereof projecting forwardly, wherein the vertical panel of the inner housing includes sides thereof projecting rearwardly in the first position thereof such that the sides of the rear panel and the sides of the vertical panel of the inner housing overlap and define a space therebetween to allow said pivotal movement of the inner housing toward the second position, and wherein there are provided sealing means interconnecting the sides of the inner housing and the sides of the outer housing to inhibit penetration of materials therein.

6. The container according to claim 5 wherein the sealing means comprise a pair of first flanges each mounted on a respective one of the sides of the outer housing and projecting therefrom inwardly toward a respective one of the sides of the inner housing and a pair of second flanges each associated with a respective one of the first flanges and mounted on a respective one of the sides of the inner housing and projecting outwardly toward the respective side of the outer housing such that the associated first and second flanges overlap, the second flange on one side of the inner housing being positioned forwardly of the associated first flange and the second flange on the other side of the inner housing being positioned rearwardly of the first flange to allow said pivotal movement of the inner housing in one direction only and to halt said pivotal movement of the inner housing after rotation of the inner housing through substantially 180° .

7. The container according to claim 6 further including a pull handle member mounted on that one of the second flanges which is positioned forwardly of the associated first flange with the pull handle projecting outwardly beyond the respective side of the outer housing for manual grasping.

8. The container according to claim 1 wherein the top panel and the bottom panel of the inner housing each includes means projecting axially outwardly therefrom so as to engage the top panel and the bottom panel, respectively, of the outer housing and to support a main part of the respective top and bottom panels in spaced location to allow an airflow therebetween.

9. The container according to claim 1 wherein the bracket member of the attachment means comprises a channel member mounted on the rear face of the vertical panel of the outer housing and defining a pair of generally upwardly and rearwardly extending side flanges, and an attachment portion for receiving the channel member thereon in a sliding action vertically downwardly, the attachment portion comprising an attachment plate and a pair of attachment flanges extending generally upwardly and generally forwardly toward a rear surface of the vertical panel of the outer housing, the attachment plate having connector means thereon for attachment to said support member.

10. The container according to claim 1 further including a latch mechanism for latching the inner housing in the first position, the latch mechanism having a frangible seal thereon.

11. The container according to claim 1 including an inspection card holder mounted on a face of the vertical panel of the inner housing adjacent to the fire extinguisher so that the holder is accessible only by removal of the fire extinguisher.

12. A container for a fire extinguisher comprising an outer housing having a top substantially horizontal panel, a bottom substantially horizontal panel, and a rear generally vertical panel interconnecting the top and bottom panels, attachment means for mounting the outer housing on a support member with a front open face of the outer housing exposed; an inner housing comprising a top substantially horizontal panel, a bottom substantially horizontal panel and a substantially vertical panel interconnecting the top and bottom panels of the inner housing; means for mounting the fire extinguisher in the inner housing; pivot means mounting the bottom panel of the inner housing on the top of the bottom panel of the outer housing and mounting the top panel of the inner housing underneath the top panel of the outer housing for pivotal movement of the inner housing relative to the outer housing about a common substantially vertical axis from a first position in which the vertical panel of the inner housing faces forwardly and cooperates with the rear panel of the outer housing to substantially enclose a hollow interior for receiving the fire extinguisher to a second position in which the vertical panel of the inner housing lies adjacent the rear panel of the outer housing with the fire extinguisher exposed forwardly of the vertical panel of the inner housing; the rear panel of the outer housing including sides thereof projecting forwardly and the vertical panel of the inner housing including sides thereof projecting rearwardly in the first position thereof such that the sides of the rear panel and the sides of the vertical panel of the inner housing overlap and define a space therebetween to allow said pivotal movement of the inner housing toward the second position; and sealing means interconnecting the sides of the inner housing and the sides of the outer housing to inhibit the penetration of materials therein, the sealing means comprising a pair of first flanges each mounted on a respective one of the sides of the outer housing and projecting therefrom inwardly toward a respective one of the sides of the inner housing and a pair of second flanges each associated with a respective one of the first flanges and mounted on a respective one of the sides of the inner housing and projecting outwardly toward the respective one of the sides of the outer housing such that the associated first and second flanges overlap, the second flange on one side of the inner housing being positioned forwardly of the associated first flange and the second flange on the other side of the inner housing being positioned rearwardly of the associated first flange to allow said pivotal movement of the inner housing in one direction only and to halt and pivotal movement of the inner housing after rotation of the inner housing through substantially 180° .

13. The container according to claim 12 further including a pull handle member mounted on that one of the second flanges which is positioned forwardly of the associated first flange with the pull handle projecting outwardly beyond the respective side of the outer housing for manual grasping.

14. The container according to claim 12 wherein the top panel and the bottom panel of the inner housing each includes means projecting axially outwardly therefrom so as to engage the top panel and the bottom panel, respectively, of the outer housing and to support a main part of the respective top and bottom panels in spaced location to allow an airflow therebetween.

15. The container according to claim 12 wherein the top panel of the outer housing extends forwardly to a position outwardly of the top panel of the inner housing int he first position thereof and includes a downturned lip around a periphery thereof for enclosing the top panel of the inner housing.

16. A container for a fire extinguisher comprising an outer housing having a top substantially horizontal panel, a bottom substantially horizontal panel, and a rear generally vertical panel interconnecting the top and bottom panels; attachment means for mounting the outer housing on a support member with a front open face of the outer housing exposed; an inner housing comprising a top substantially horizontal panel, a bottom substantially horizontal panel, and a substantially vertical panel interconnecting the top and bottom panels of the inner housing; means for mounting the fire extinguisher in the inner housing; and pivot means mounting the bottom panel of the inner housing on a top of the bottom panel of the outer housing and mounting the top panel of the inner housing underneath the top panel of the outer housing for pivotal movement of the inner housing relative to the outer housing about a common substantially vertical axis from a first position in which the vertical panel of the inner housing faces forwardly and cooperates with the rear panel of the outer housing to substantially enclose a hollow interior for receiving the fire extinguisher to a second position in which the vertical panel of the inner housing lies adjacent the rear panel of the outer housing with the fire extinguisher exposed forwardly of the vertical panel of the inner housing; the top panel of the outer housing extending forwardly to a position outwardly of the top panel of the inner housing in the first position thereof and including a downturned lip around a periphery thereof for enclosing the top panel of the inner housing, the top panel and the bottom panel of the inner housing each including means projecting axially outwardly therefrom so as to engage the top panel and the bottom panel, respectively, of the outer housing and to support a main part of the respective top and bottom panels in spaced location to allow an airflow therebetween.

* * * * *